US008776398B2

(12) United States Patent
McLinden

(10) Patent No.: US 8,776,398 B2
(45) Date of Patent: Jul. 15, 2014

(54) ABSORBENT FOOTWEAR LINER

(75) Inventor: Shannon Michelle McLinden, Frisco, TX (US)

(73) Assignee: Summer Soles, LLC, Frisco, TX (US)

( * ) Notice: Subject to any disclaimer, the term of this patent is extended or adjusted under 35 U.S.C. 154(b) by 5 days.

(21) Appl. No.: 13/404,815

(22) Filed: Feb. 24, 2012

(65) Prior Publication Data

US 2012/0180337 A1 Jul. 19, 2012

Related U.S. Application Data

(63) Continuation of application No. 12/432,508, filed on Apr. 29, 2009, now Pat. No. 8,151,487, which is a continuation-in-part of application No. 12/413,263, filed on Mar. 27, 2009, now abandoned, which is a continuation-in-part of application No. 11/380,954, filed on May 1, 2006, now abandoned.

(60) Provisional application No. 60/686,666, filed on Jun. 2, 2005.

(51) Int. Cl.

| | |
|---|---|
| ***A43B 13/38*** | (2006.01) |
| ***A43B 7/14*** | (2006.01) |
| ***A43B 17/10*** | (2006.01) |
| ***A43B 17/02*** | (2006.01) |
| ***A43B 1/00*** | (2006.01) |

(52) U.S. Cl.

CPC ..... *A43B 17/02* (2013.01); *A43B 7/144* (2013.01); *A43B 17/102* (2013.01); *A43B 7/1425* (2013.01); *A43B 1/0045* (2013.01)

USPC ..... 36/43; 36/44

(58) Field of Classification Search

USPC ..... 36/43, 44

See application file for complete search history.

(56) References Cited

U.S. PATENT DOCUMENTS

| | | | |
|---|---|---|---|
| 275,767 | A | 4/1883 | Hill |
| 859,113 | A | 7/1907 | Roosa |
| 871,891 | A | 11/1907 | Roosa |
| 1,588,173 | A | 6/1925 | Cummings |
| 1,841,942 | A | 1/1932 | Fenton |
| 1,867,431 | A | 7/1932 | Wood |
| 2,121,604 | A | 6/1938 | Semke et. al. |
| 2,865,097 | A | 12/1958 | Vollrath, Jr. et. al. |
| 2,917,807 | A | 12/1959 | Scholl |
| 3,052,904 | A | 9/1962 | Reid et. al. |
| 3,312,001 | A | 4/1967 | Tibbitts, Jr. et. al. |
| 3,724,106 | A | 4/1973 | Magidson |

(Continued)

FOREIGN PATENT DOCUMENTS

WO WO 2006101504 9/2006

OTHER PUBLICATIONS

Terrycloth Shoe insert, PumpPals by Pedifix, 6-7, 8-9.
Foot petals 2003, Poron Performance Urethanes.

(Continued)

*Primary Examiner* — Marie Bays

(74) *Attorney, Agent, or Firm* — Kirby B. Drake; Klemchuk Kubasta LLP

(57) ABSTRACT

An absorbent footwear liner comprising an upper absorbent layer and a lower layer comprising an adhesive equal in size to the upper layer for adhering the liner to substantially the entire surface of a footbed for absorbing and dissipating moisture thereon and preventing foot slippage on a shoe footbed due to perspiration.

9 Claims, 5 Drawing Sheets

(56) References Cited

U.S. PATENT DOCUMENTS

| | | | | |
|---|---|---|---|---|
| 4,055,699 | A | 10/1977 | Hsiung | |
| 4,151,660 | A | 5/1979 | Yoshimi et al. | |
| 4,185,402 | A | 1/1980 | Digate | |
| 4,186,499 | A | 2/1980 | Massok, Jr. et al. | |
| 4,192,086 | A | 3/1980 | Sichak | |
| 4,257,176 | A | 3/1981 | Hartung et al. | |
| 4,631,841 | A | 12/1986 | Hickey | |
| 4,642,912 | A | 2/1987 | Wildman et al. | |
| 4,689,899 | A | 9/1987 | Larson et al. | |
| 4,727,661 | A | 3/1988 | Kuhn | |
| 4,808,458 | A | 2/1989 | Watt et al. | |
| 4,864,740 | A | 9/1989 | Oakley | |
| 5,388,349 | A | 2/1995 | Ogden | |
| 5,625,965 | A | 5/1997 | Blissett et al. | |
| 5,727,336 | A | 3/1998 | Ogden | |
| 5,799,414 | A | 9/1998 | Kellerman | |
| 5,935,671 | A | 8/1999 | Lhuillier | |
| 6,131,221 | A | 10/2000 | Yang | |
| 6,182,377 | B1 * | 2/2001 | Toensing | 36/8.1 |
| 6,185,844 | B1 | 2/2001 | Janzen | |
| 6,205,685 | B1 | 3/2001 | Kellerman | |
| 6,939,502 | B2 | 9/2005 | Lyden | |
| 7,047,671 | B2 | 5/2006 | Steed et al. | |
| 8,151,487 | B2 * | 4/2012 | McLinden | 36/43 |
| 2002/0066209 | A1 | 6/2002 | Steed et al. | |
| 2003/0084594 | A1 | 5/2003 | Korn | |
| 2005/0257398 | A1 | 11/2005 | Blackmer | |
| 2006/0254088 | A1 * | 11/2006 | McCormick | 36/44 |
| 2007/0119077 | A1 | 5/2007 | Yoo | |

OTHER PUBLICATIONS

Advertisement for Dr. Scholl's for Her Open Shoe Insoles, 2005, Schering-Plough HealthCare Products, Inc.

* cited by examiner

ABSORBENT FOOTWEAR LINER

CROSS REFERENCE TO RELATED APPLICATIONS

This application is a continuation of U.S. patent application Ser. No. 12/432,508, filed Apr. 29, 2009 and entitled "ABSORBENT FOOTWEAR LINER," which is a continuation-in-part of U.S. patent application Ser. No. 12/413,263 filed Mar. 27, 2009, which is a continuation-in-part of U.S. patent application Ser. No. 11/380,954 filed May 1, 2006, which is a non-provisional patent application of U.S. patent application Ser. No. 60/686,666 filed Jun. 2, 2005, and the contents of each are hereby incorporated by reference for all purposes.

FIELD OF INVENTION

The present disclosure relates generally to footwear liners, and more particularly to an absorbent footwear liner that substantially covers a footwear sole for absorbing and dissipating perspiration from a foot engaged therewith.

There are over 250,000 sweat glands in a human foot. Unfortunately, shoes are not created with this in mind. Perspiration not only causes odor but also causes the surface of the foot to become moist. In fact the human foot has the capacity to produce at least ½ a cup of perspiration per day.

Typical footbeds of non-athletic shoes such as pumps, loafers, and sandals comprise a liner manufactured from a leather, plastic, or synthetic material which cannot absorb nor release foot produced perspiration. As a result, feet accumulating perspiration thereon slip on the footbeds causing the foot to shift inside the shoe and even slip completely out of the shoe in some cases. Further, persons with hyperhidrosis, commonly referred to as excessive sweating, have even more difficulties with typical footbeds such that simply keeping an open shoe on their feet is nearly impossible.

Heretofore shoe liners have been available for orthotic purposes, for overall cushioning, and as inserts for either the heel or ball of a foot to improve overall fit of the shoe. Existing shoe liners have not been designed to absorb moisture and prevent slippage due to perspiration. Further, existing shoe liners typically have adhesive tabs that do not secure the entire liner.

The present disclosure comprises an absorbent shoe liner that overcomes foregoing and other difficulties. In accordance with the broader aspects of the disclosure, an absorbent shoe liner comprises an upper footbed layer that absorbs and dissipates perspiration and a lower layer comprising an adhesive area equal in size to the upper footbed layer for adhering the liner to substantially the entire surface of the footbed of a shoe.

In accordance with the present disclosure, an absorbent shoe liner comprises an upper layer comprising a fabric with moisture wicking capabilities and a lower layer comprising an adhesive material. Both the upper and lower layers extend across the entire footbed of a shoe covering the footbed from edge to edge and end to end. The fabric comprising the upper layer absorbs excess moisture from the foot thereby preventing the foot from slipping out of the shoe and further absorbing bacteria which prevents accumulation of odor inside the shoe. The adhesive lower layer keeps the shoe liner secure on the footbed of the shoe.

The upper layer may also include additional foam material substantially near where the ball or heel of the foot rests thereon for providing cushion for the foot. The foam material may be adhered either above or below the upper layer.

The shoe liner of the present disclosure is equally applicable to both open and closed toed shoes for men, women, and children. The shoe liner can be fitted to nearly all shoe sizes by simply trimming the perimeter thereof. In addition to absorbing moisture and odor and preventing foot slippage, the shoe liner also provides a soft surface on which the foot rests contributing to the wearer's overall comfort. Further, the shoe liner may be also adhered to an orthotic that is placed inside a shoe, instead of directly onto the footbed of a shoe.

The shoe liner of the present disclosure may further include an additional layer comprising a gel material. The additional gel layer is placed beneath the lower adhesive layer. The gel layer adheres the shoe liner to a footbed of a shoe while providing additional cushioning.

DESCRIPTION OF THE DRAWINGS

A more complete understanding of the present disclosure may be had by reference to the following Detailed Description when taken in connection with the accompanying Drawings, wherein.

DETAILED DESCRIPTION

Figure 1A:
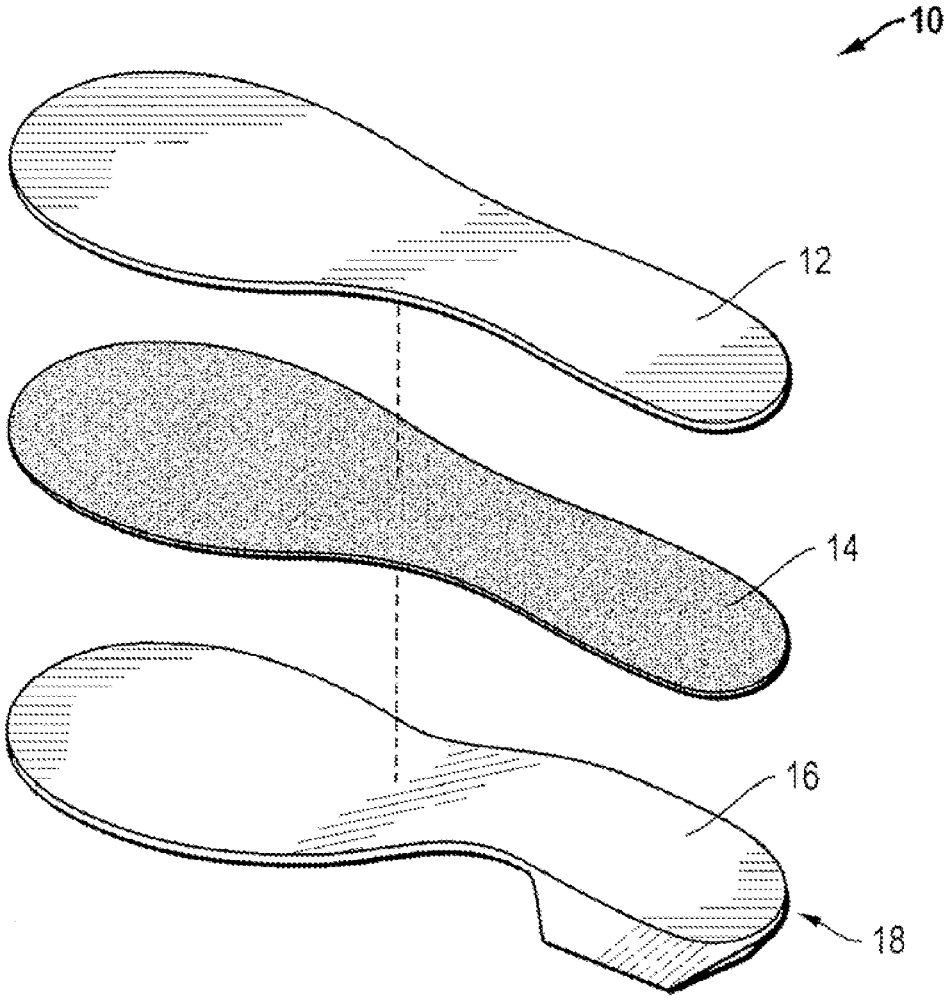
FIG. 1A is an exploded perspective view of a shoe liner comprising a first embodiment of the present disclosure.

Referring now to the Drawings, and particularly to FIG. 1A, there is shown a footwear liner 10 comprising a first embodiment of the present disclosure. The footwear liner 10 comprises an upper layer 12 and a lower layer 14 adhered therebelow. The lower layer 14 comprises an adhesive material whereby the shoe liner covers and is adhered to an upper surface 16 of a footbed 18.

The upper layer 12 comprises a fabric material capable of absorbing and dissipating moisture such as a woven synthetic suede comprising 100% polyester or a non-woven athletic-wool felt comprising 70% wool and 30% rayon, or other manmade or natural textile blends, including microfibers, or other suitable materials known to those skilled in the art.

The lower layer 14 comprises a double-sided adhesive film such as double-faced acrylic pressure sensitive adhesive tape with release liner sold by AdChem Corporation under the Product Name Adchem 8311 M-76G-54 or other suitable adhesive materials known to those skilled in the art, including those applied by pressure-sensitive tape equipment, spray, slot die, sheet, roller coating, continuous pour, and embossed patterns, to maintain the upper layer 12 in adhesive engagement with a leather, plastic or synthetic material while leaving no residue once removed from the upper surface 16 of the footbed 18. Both the upper layer 12 and lower layer 14 are formed such that the shoe liner 10 substantially covers the entire upper surface 16 of the footbed 18 and the entire shoe liner 10 is maintained in adhesive engagement therewith.

Figure 1B:
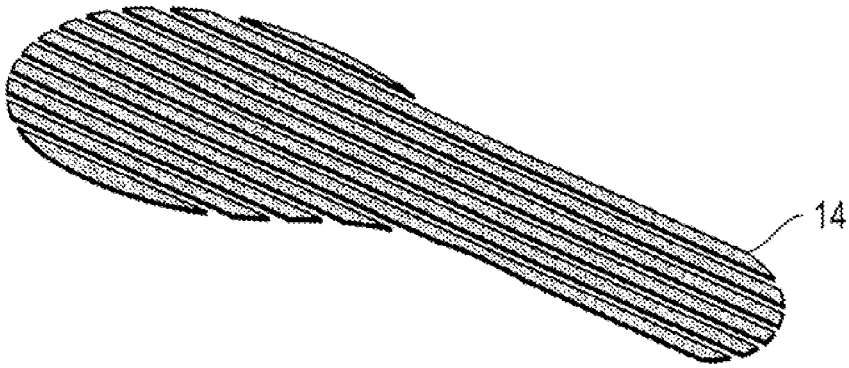
FIG. 1B is a perspective view of the adhesive layer of the embodiment shown in FIG. 1A having a different adhesive pattern.
Figure 1C:
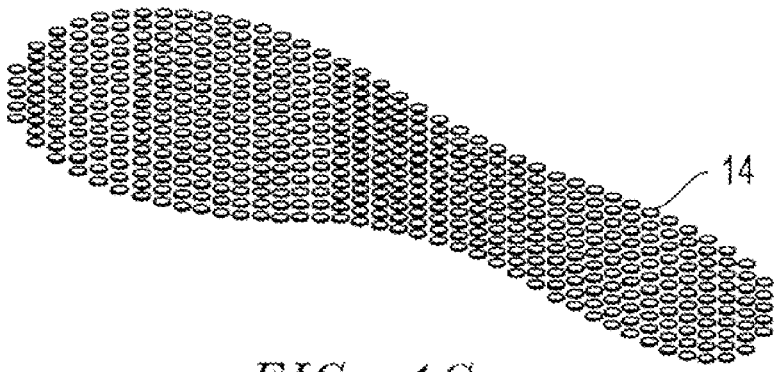
FIG. 1C is a perspective view of the adhesive layer of the embodiment shown in FIG. 1A having yet another adhesive pattern.
Figure 1D:
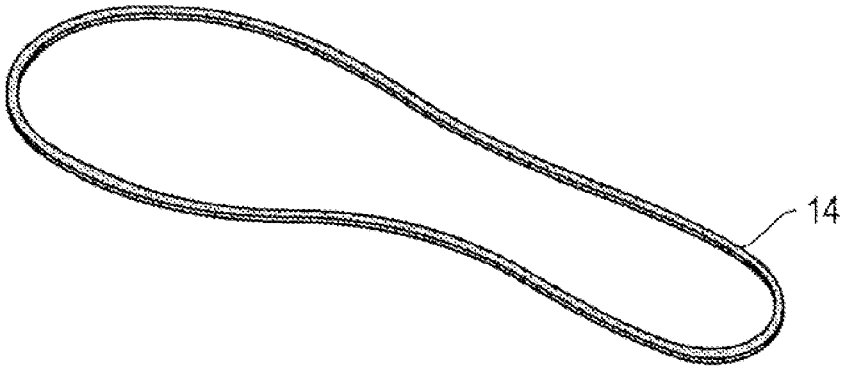
FIG. 1D is a perspective view of the adhesive layer of the embodiment shown in FIG. 1A having yet another adhesive pattern.

FIG. 1B illustrates an alternative lower layer 14 having an adhesive comprising a series of stripes extending longitudinally along substantially the entire layer 14. This series of stripes could also extend transversely across substantially the entire layer 14. FIG. 1C illustrates an alternative lower layer 14 having an adhesive comprising a series of circular applications positioned substantially across the entire length and width of layer 14. FIG. 1D illustrates yet another alternative lower layer 14 having an adhesive comprising a strip extending about the entire perimeter of the upper layer 12.

Figure 2:
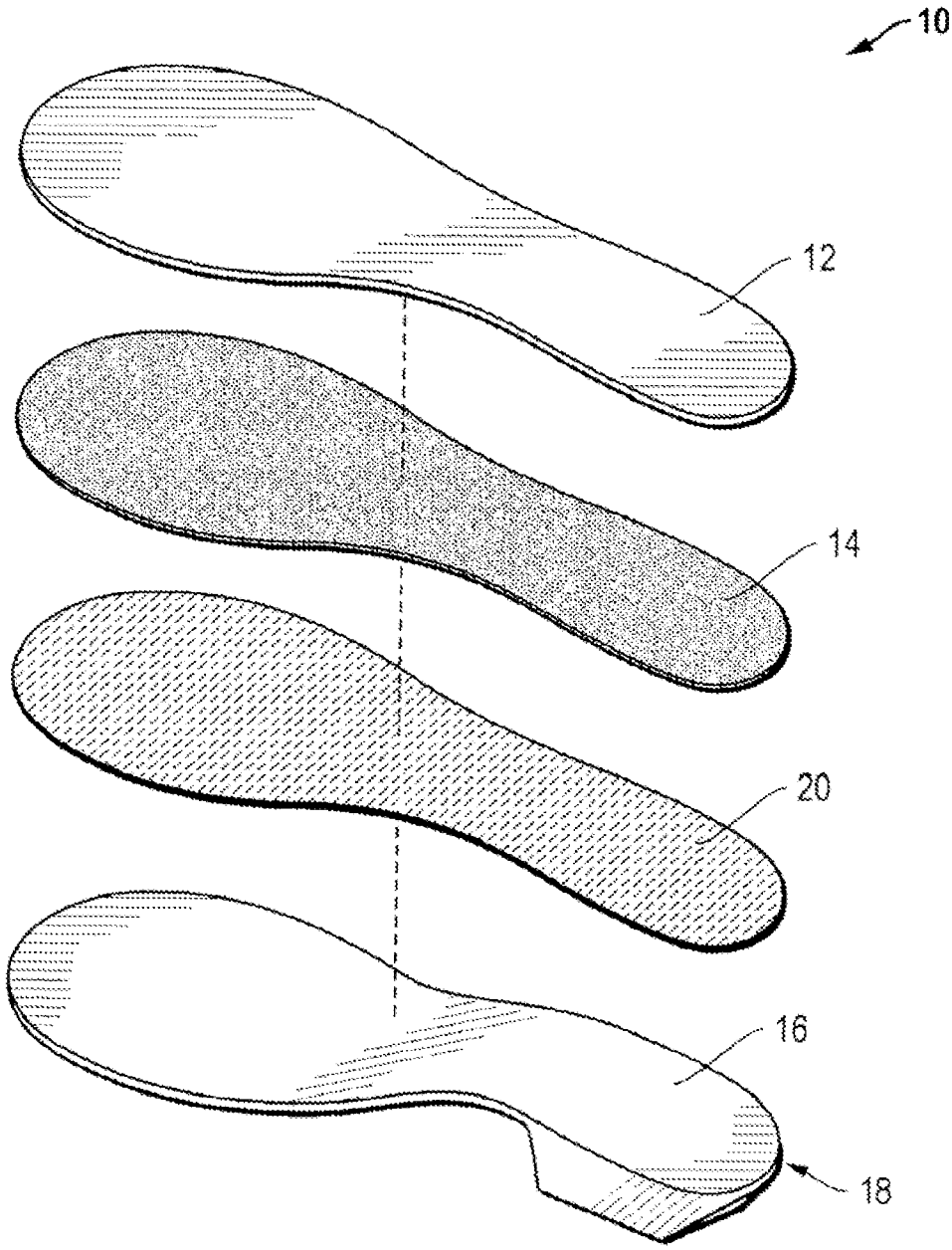
FIG. 2 is an exploded perspective view of a shoe liner comprising a second embodiment of the present disclosure.

FIG. 2 illustrates the shoe liner 10 having an additional lower layer 20 comprising a gel material. The gel layer 20 comprises a gel material that adheres the shoe liner 10 to the footbed 18 while providing additional cushioning and comfort to a foot resting thereon. The gel layer 20 may be fabricated from a biodegradable synthetic material or other suitable materials known to those skilled in the art.

Figure 3:
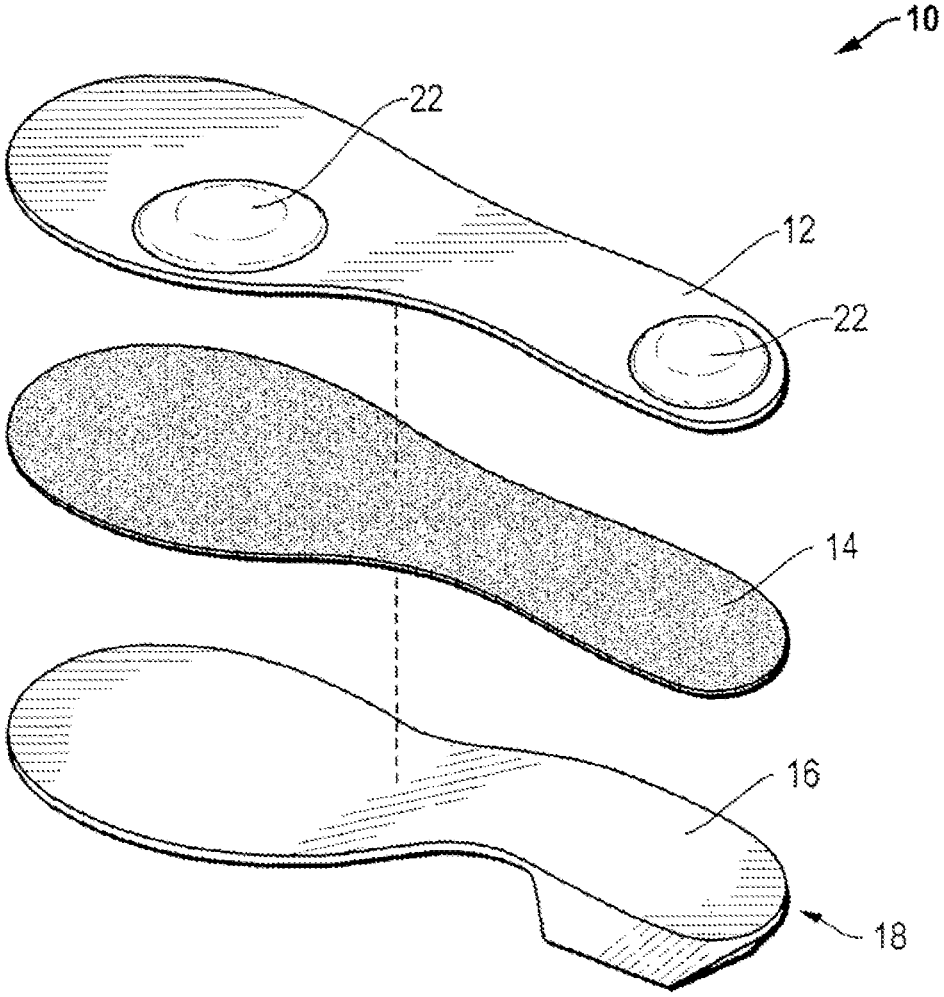
FIG. 3 is an exploded perspective view of a shoe liner comprising a third embodiment of the present disclosure.

FIG. 3 illustrates the shoe liner 10 wherein the upper layer 12 comprises additional foam support 22 adhered to the upper layer 12 substantially near the location where the ball and the heel of the foot rest thereon.

Figure 4:
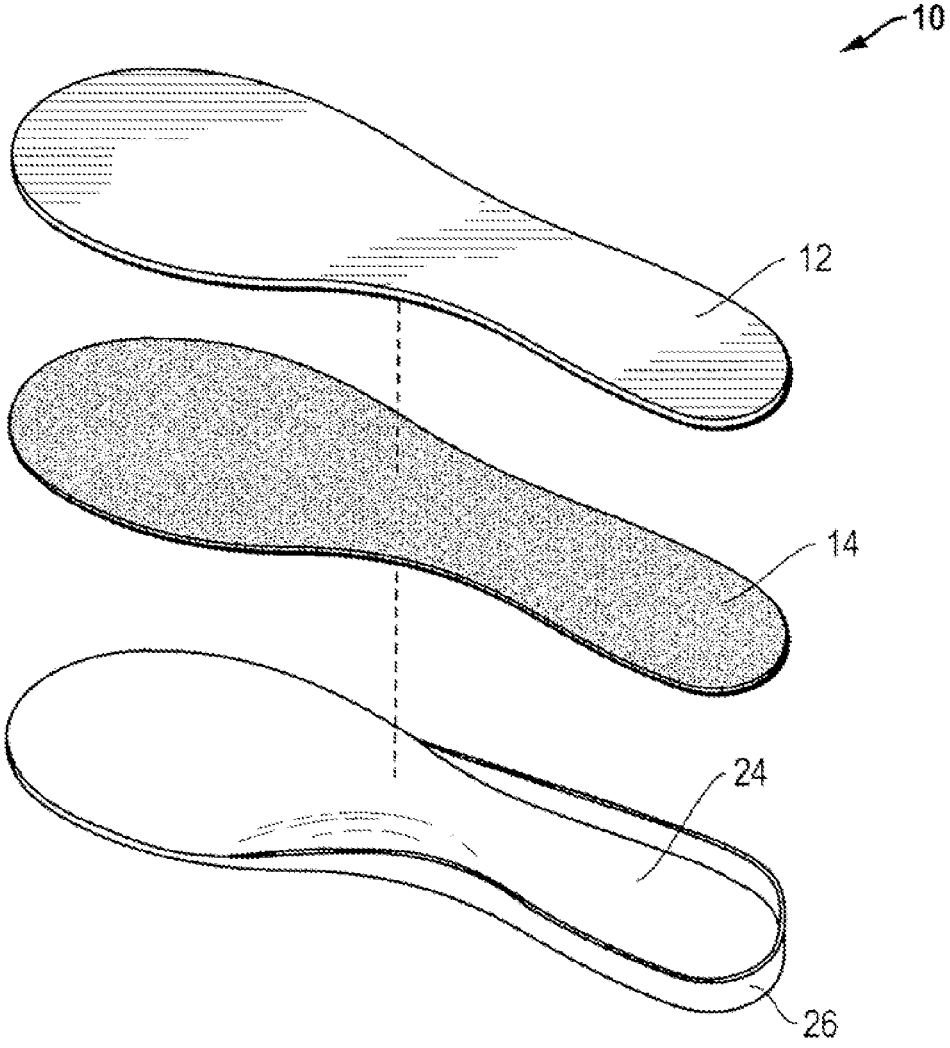
FIG. 4 is an exploded perspective view of a shoe liner comprising the embodiment of FIG. 1 applied to an insertable shoe orthotic.

FIG. 4 illustrates the shoe liner 10 adhered to the surface 24 of an orthotic 26 for insertion into a shoe. In FIG. 4 the shoe liner 10 is illustrated in accord with the embodiment of FIG. 1, but the embodiments of FIGS. 2 and 3 can also be applied to the orthotic 26.

The shoe liner is illustrated in conjunction with a right foot configuration but is equally applicable to a left foot configuration. Further, the shoe liner of the present disclosure is equally applicable to both open and closed toed shoes for men, women, and children. The shoe liner is fitted to nearly all shoe sizes by simply trimming the perimeter thereof.

In accordance with another aspect of the disclosure, the upper layer 12 of the shoe liner 10 comprises a non-woven felt blend consisting of about 70% wool and about 30% rayon having a coefficient of friction of between about 0.381 and about 0.496. The low coefficient of friction of the foot-contacting surface of the shoe insert of the present disclosure allows the foot to slide across the insert, allowing perspiration within the fibrous insert to move from a stagnant position and allowing the foot to feel dry and comfortable as it glides over the insert.

The upper layer 12 of the shoe liner 10 may also comprise a woven fabric material, such as faux suede consisting of 100% polyester and having a higher coefficient of friction of between 0.480 and about 0.589. The low coefficient of friction of the foot contacting the surface of the woven faux suede shoe insert allows for less foot slippage when the insert is used in higher heeled shoes. Our preferred fabric is a 100% Polyester faux suede sold with woven cotton fabric bonded to the back side for additional fabric support. Such fabric is available through Burch Fabrics of Grand Rapids, Mich. The bonding of additional fabrics to the backside for support does not affect the face side of the faux suede that comes into contact with the foot. Note that the upper layer 12 of the shoe liner may also be treated with fragrance, deodorizer, or antimicrobials for added benefits.

One suitable fragrance encapsulate solution is Hydrosal™ spheres suspended in water and in hydro-alcoholic environments, ideal for spray, water-based, alcoholic and gel products available through Salvona Technologies of Dayton, N. J. Hydrosal™ provides longer lasting effects and in some cases water triggered release of fragrance. Surface treatments can be applied via a "spray method" or "contact coated." Our preferred method involves spraying the solution onto the material.

One suitable antimicrobial is SmartSilver™ available through NanoHorizons of State College, Pa. SmartSilver's unique silver nanoparticle additives combine silver's natural antimicrobial properties with nanotechnology to provide permanent, safe protection against germs and odors. Surface treatments can be applied via a "spray method" or "dye bath" process. Our preferred method involves applying SmartSilver during the dye bath process of fabric production.

Although preferred embodiments of the present disclosure have been illustrated in the accompanying Drawings and described in the foregoing Detailed Description, it will be understood that the present disclosure is not limited to the embodiments disclosed, but is capable of numerous rearrangements, modifications and substitutions of parts and elements without departing from the spirit of the present disclosure.

The invention claimed is:

1. A liner for placement upon an upper surface of a footbed of an article of footwear to absorb moisture, comprising:

a layer of moisture absorbing woven polyester fabric having a coefficient of friction between about 0.480 and about 0.589;

the woven polyester fabric extending across substantially the entire upper surface of the footbed when placed thereon;

a first adhesive permanently adhering the bottom surface of the woven polyester fabric to an upper surface of a woven cotton fabric; and a second adhesive removably adhering the bottom surface of the woven cotton fabric to the upper surface of the footbed, the second adhesive covering substantially the entire bottom surface of the woven cotton fabric.

2. The liner according to claim 1, wherein the woven polyester fabric is faux suede formed of polyester.

3. The liner according to claim 1, wherein the woven polyester fabric further comprises additional material to cushion the ball and heel of a foot resting thereon.

4. A liner for placement upon an upper surface of a footbed of an article of footwear to absorb moisture, comprising:

a moisture absorbing woven polyester fabric layer having a coefficient of friction of between about 0.480 and about 0.589;

a moisture absorbing woven cotton fabric layer permanently adhered to a bottom surface of the woven polyester fabric layer; and a cushioning and support layer adhered to a bottom surface of the woven cotton fabric layer;

wherein each of the layers are shaped so that they extend across substantially the entire upper surface of the footbed when placed thereon.

5. The liner according to claim 4, wherein the cushioning and support layer comprises a gel material.

6. The liner according to claim 4, wherein the cushioning and support layer comprises a foam material.

7. The liner according to claim 6, further comprising an adhesive removably adhering the bottom surface of the foam material to the upper surface of the footbed.

8. The liner according to claim 4 wherein the woven polyester fabric further comprises additional material to cushion the ball and heel of a foot resting thereon.

9. A liner for placement upon an upper surface of a footwear to absorb moisture, comprising:

a layer of moisture absorbing woven polyester fabric having a top and a bottom surface;

the moisture absorbing layer consisting of about 100% polyester and having a coefficient of friction of between about 0.480 and about 0.589;

an adhesive permanently adhering the bottom surface of the moisture absorbing woven polyester fabric to an upper surface of a woven cotton fabric layer; and an adhesive removably adhering the bottom surface of the layer of woven cotton fabric to the upper surface of the footwear;

wherein each of the layers extends across substantially the entire upper surface of the footwear when placed thereon.

* * * * *